US007609255B2

(12) United States Patent
Frederick et al.

(10) Patent No.: US 7,609,255 B2
(45) Date of Patent: Oct. 27, 2009

(54) SUPPLYING POWER FROM A DISPLAY DEVICE TO A SOURCE USING A STANDARD DVI VIDEO CABLE

(75) Inventors: John W. Frederick, Spring, TX (US); Christopher D. Voltz, Spring, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 848 days.

(21) Appl. No.: 11/192,679

(22) Filed: Jul. 29, 2005

(65) Prior Publication Data

US 2007/0028281 A1 Feb. 1, 2007

(51) Int. Cl.
*G09G 5/00* (2006.01)

(52) U.S. Cl. ..... 345/211; 710/65

(58) Field of Classification Search ..... 345/211–213, 345/204, 3.1, 98, 104; 710/15, 62, 65, 106, 710/302, 313; 725/130, 131, 133
See application file for complete search history.

(56) References Cited

U.S. PATENT DOCUMENTS

| | | | | |
|---|---|---|---|---|
| 6,943,753 | B2 * | 9/2005 | Shirasaki et al. | 345/3.1 |
| 2002/0049879 | A1 * | 4/2002 | Eyer | 710/305 |
| 2004/0165119 | A1 * | 8/2004 | Choi et al. | 348/839 |

* cited by examiner

*Primary Examiner*—Jimmy H Nguyen

(57) ABSTRACT

A source unit is configured to receive its main power supply from pin 14 of a DVI-compliant cable connector. A display device is operable to connect its power supply to pin 14 of a DVI-compliant cable connector to accommodate the main power requirements of a source unit.

7 Claims, 2 Drawing Sheets

SUPPLYING POWER FROM A DISPLAY DEVICE TO A SOURCE USING A STANDARD DVI VIDEO CABLE

FIELD OF THE INVENTION

This invention relates generally to computer or media systems having a source unit coupled to a display device by a video cable. More specifically, the invention relates to techniques for providing power to the source unit in such systems.

BACKGROUND

In personal computer systems as well as in entertainment systems, it is standard practice to couple a video source unit to a display device by means of at least one cable. For example, it is common to couple the main unit of a personal computer or the media box of an entertainment system to a monitor or television-style display screen by means of a Digital Visual Interface ("DVI") cable.

In these and other similar systems, both the video source unit and the display device must have a power supply. Consequently, the weight, the heat generation characteristics and the expense of a power supply must be accommodated in both the source unit and the display device. Moreover, both of the power supplies require an a/c power cord and therefore contribute to what has already become a cable-management challenge in such systems.

DETAILED DESCRIPTION OF THE PREFERRED EMBODIMENTS

Figure 1:
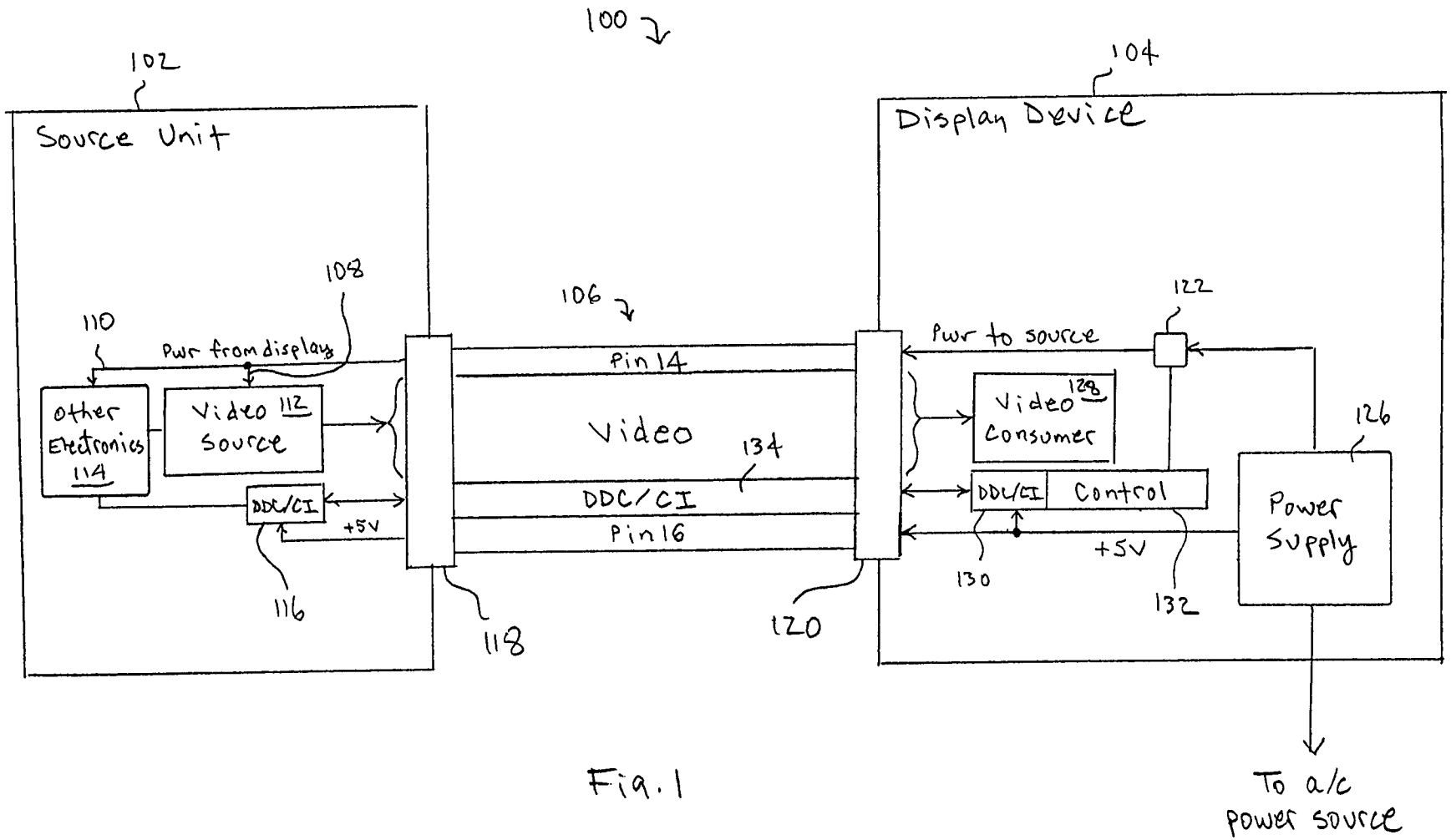
FIG. 1 is a schematic diagram illustrating a source unit and display device system according to a preferred embodiment of the invention wherein the display device supplies power to the source unit over a standard DVI video cable.

The DVI standard specifies that, in a conventional DVI system, a personal computer drives +5V to a monitor over pin 14, and the personal computer couples its hot plug detect sensing logic to pin 16. In such a conventional system, the monitor uses the +5V it receives from the personal computer on pin 14 to raise hot plug detect pin 16 to +5V. By way of contrast, FIG. 1 illustrates a system 100 according to a preferred embodiment of the invention.

In system 100, a source unit 102 and a display device 104 are coupled together by a standard DVI-compliant video cable 106 using DVI-compliant connectors 118, 120. Source unit 102 is configured to receive its main power supply from pin 14 of cable 106. For example, a video source 112 within source unit 102 may be configured to receive its main power supply from pin 14 as indicated at 108, or other electronics 114 may be so configured as indicated at 110, or both. But a DDC/CI ("Display Data Channel Command Interface") communications section 116 of source unit 102 is configured to operate using +5V supplied on pin 16 of cable 106 instead of by any power supply internal to source unit 102.

Display device 104 includes a switch 122 for connecting pin 14 of connector 120 either to a power supply 126 or not. Display device 104 also includes a video consumer 128, DDC/CI communications logic 130 and control logic 132. Power supply 126 is configured to drive +5V to source unit 102 on pin 16 of cable 106 as shown. Control logic 132 is configured to operate switch 122 responsive to a DDC/CI command received by logic 130 over cable 106 from source unit 102. Video source 112 is configured to transmit video signals to video consumer 128 in a conventional manner over cable 106.

Source unit 102 may take any of a variety of forms. For example, source unit 102 may be a personal computer, or may be a media box in an entertainment system. Display device 104 may also take a variety of forms. For example, display device 104 may be a computer monitor or a television-style display.

Figure 2:
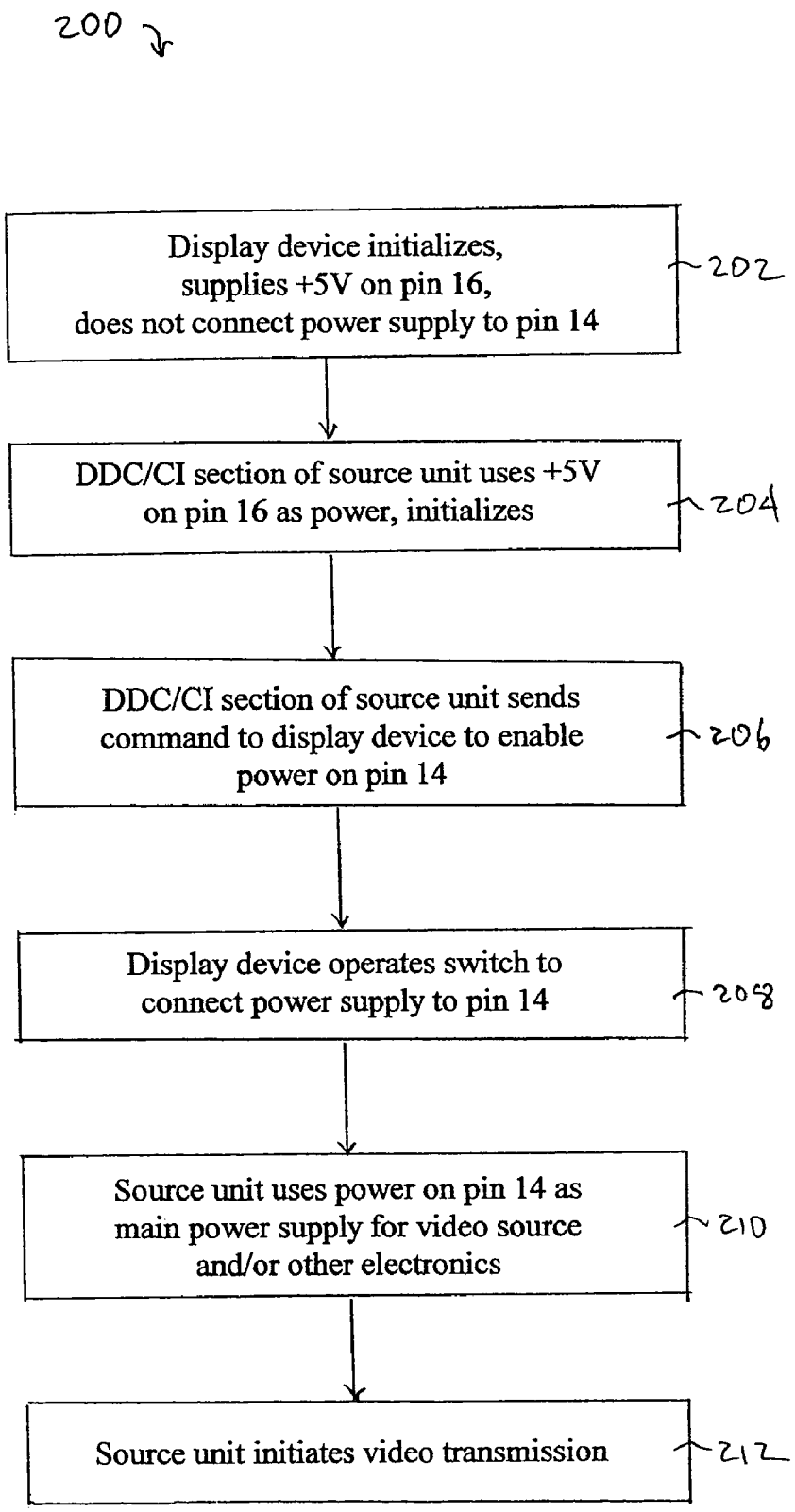
FIG. 2 is a flow diagram illustrating preferred operating behavior for the system of FIG. 1.

FIG. 2 illustrates preferred operating behavior 200 for a system such as system 100. In step 202, display device 104 is initialized to a first state wherein it supplies +5V to pin 16 of cable 106, and does not connect power supply 126 to pin 14 of cable 106. In this first state, display device 106 is compatible with a standard source unit. In step 204, DDC/CI section 116 of source unit 102 uses the +5V on pin 16 as its power supply, and initializes itself. In step 206, DDC/CI section 116 sends a command to display device 104 via DDC channel 134 of cable 106. The command sent is designed to indicate that display device 104 should begin supplying power on pin 14 of cable 106. In step 208, responsive to the command, display device 104 operates switch 122 to connect power supply 126 to pin 14 of cable 106. Thereafter, in steps 210 and 212, source unit 102 may utilize the power supplied by display device 104 on pin 14 to operate video source 112 and/or other electronics 114.

The power supplied by display device 104 to source unit 102 on pin 14 may vary depending on the requirements and capabilities of the two devices. In one embodiment, for example, display device 104 may provide up to 40V at up to 3A to accommodate a need for up to 120W. Other volt/amp configurations may also be employed.

While the invention has been described in detail with reference to preferred embodiments thereof, the described embodiments have been presented by way of example and not by way of limitation. It will be understood by those skilled in the art that various changes may be made in the form and details of the described embodiments without deviating from the spirit and scope of the invention as defined by the appended claims.

What is claimed is:

1. A system, comprising:

a source unit, a display device and a DVI-compliant video cable coupling the source unit to the display device; wherein:

the source unit is configured to receive its main power supply from pin 14 of the DVI-compliant video cable, but also comprises a DDC/CI communications capability powered by +5V supplied by the display device on pin 16 of the DVI-compliant video cable;

the display device comprises a switch for connecting pin 14 of the DVI-compliant video cable to, or disconnecting it from, a power supply; and the switch is operable responsive to a DDC/CI command received by the display device from the source unit.

2. The system of claim 1, wherein:

the source unit comprises a video source configured to transmit video signals over wires of the DVI-compliant video cable that are conventionally used to transmit video signals; and the video source receives its main power supply from pin 14 of the DVI-compliant video cable.

3. The system of claim 1, wherein the source unit is a media box.

4. The system of claim 1, wherein the source unit is a personal computer.

5. An operating method for a source unit and display device coupled to one another by a DVI-compliant cable, comprising:

initializing the display device to a first state wherein the display device supplies +5V to pin 16 of the cable and does not connect pin 14 of the cable to a power supply in the display device;

using the +5V on pin 16 of the cable to supply power to DDC/CI communications logic in the source unit and initializing the DDC/CI communications logic;

sending a command from the DDC/CI communications logic in the source unit to corresponding logic in the display device, the command for enabling a second state in the display device;

in the display device, entering the second state responsive to the command, wherein the second state comprises connecting pin 14 of the cable to the power supply.

6. The method of claim 5, further comprising:

using power supplied by the display device on pin 14 of the cable to operate a video source in the source unit; and transmitting video signals from the source unit to the display device over the DVI-compliant cable.

7. A system, comprising:

a source unit coupled to a display device by a DVI-compliant cable;

means in the source unit for using +5V on pin 16 of the cable to power itself and send a DDC/CI command to the display device, the command for requesting the display device to connect a power supply in the display device to pin 14 of the cable; and means in the display device for connecting the power supply to pin 14 of the cable responsive to the command.

* * * * *